US006038702A

United States Patent [19]

Knerr

[11] Patent Number: 6,038,702

[45] Date of Patent: Mar. 21, 2000

[54] DECORATIVE PATCH

[76] Inventor: Charles R. Knerr, 948 S. Third St., P.O. Box 1571, Jacksonville, Oreg. 97530

[21] Appl. No.: 09/139,293

[22] Filed: Aug. 25, 1998

[51] Int. Cl.[7] ..... A41D 27/08

[52] U.S. Cl. ..... 2/244; 2/243.1; 428/79; 428/137

[58] Field of Search ..... 2/46, 69, 75, 80, 2/115, 122, 133, 134, 136, 209.13, 241, 243.1, 244, 246, 248, 265, 266, 255, DIG. 1; 428/78, 79, 102, 103, 131, 134, 137; 40/586, 638; 156/256, 63

[56] References Cited

U.S. PATENT DOCUMENTS

| | | | |
|---|---|---|---|
| 1,066,477 | 7/1913 | Feder | 2/266 |
| 1,960,312 | 5/1934 | Landorf | 2/133 |
| 2,548,104 | 4/1951 | Frison | 40/1.6 |
| 2,671,902 | 3/1954 | Grue | 2/247 |
| 2,748,517 | 6/1956 | Berkis | 41/34 |
| 3,163,866 | 1/1965 | Denmark | 2/68 |
| 3,244,578 | 4/1966 | Markus | 428/79 |
| 3,490,864 | 1/1970 | Witzig | 2/266 |
| 3,509,003 | 4/1970 | Engle | 428/79 |
| 3,536,554 | 10/1970 | Weiss | 2/266 |
| 3,636,569 | 1/1972 | Nielson | 2/266 |
| 4,270,227 | 6/1981 | Wolfe | 2/DIG. 1 |
| 4,365,353 | 12/1982 | Rayl | 2/115 |
| 4,389,801 | 6/1983 | Sharrock et al. | 40/159 |
| 4,427,472 | 1/1984 | Trager | 156/93 |
| 4,513,454 | 4/1985 | Anderson et al. | 2/246 |
| 4,788,972 | 12/1988 | DeBusk | 2/DIG. 1 |
| 4,813,081 | 3/1989 | Cliff | 2/115 |
| 5,005,218 | 4/1991 | Ganz | 2/244 |
| 5,079,778 | 1/1992 | Sloot | 2/69 |
| 5,090,056 | 2/1992 | Stoner et al. | 2/244 |
| 5,136,726 | 8/1992 | Kellin et al. | 2/244 |
| 5,186,998 | 2/1993 | Eugster | 428/102 |
| 5,203,033 | 4/1993 | Sheppard et al. | 2/69 |
| 5,481,758 | 1/1996 | Gabler | 2/115 |
| 5,531,176 | 7/1996 | Johnson | 112/475.24 |
| 5,569,345 | 10/1996 | Kenyon | 156/93 |
| 5,817,393 | 10/1998 | Stahl | 428/102 |
| 5,832,540 | 11/1998 | Knight | 2/244 |

*Primary Examiner*—Amy Vanatta
*Attorney, Agent, or Firm*—Christie, Parker & Hale, LLP

[57] ABSTRACT

A decoration or accessory for clothing consisting of two die cut pieces of material laid on top of one another. In one embodiment a paper coated adhesive is coated on the facing sides of each piece of material. The two pieces of material each have a mating central aperture and are joined together along the edge of the central aperture by sewing, stitching or the like. The decoration is placed in a previously cut aperture in an item of clothing to be decorated with one die cut piece overlaying the exterior side of the item and the other piece overlaying the interior side of the item. The paper backing is removed from the decoration and the decoration is adhesively secured to the item. Securing by heat activated adhesive is also contemplated.

21 Claims, 1 Drawing Sheet

DECORATIVE PATCH

FIELD OF THE INVENTION

This invention relates to decorations on articles of clothing and pieces of fabric, and more particularly to patches that decorate a hole created in a garment or piece of material.

BACKGROUND OF THE INVENTION

Frequently people strive to stand out from the teeming masses of humanity by adorning their body as uniquely as possible. The present invention is addressed to this human desire in that it allows a person to modify their clothing to suit their tastes. Using this invention a person can make and reinforce a hole in their clothing anywhere their imagination may prompt them. Sometimes people have a pierced or tattooed part of their body normally covered by clothing and this invention allows them to further express themselves by exposing their pierced or tattooed flesh to the world. Additionally, such holes in a person's clothing allow the person to exchange heat more effectively with the surrounding environment and thus stay cooler on a hot day.

If a person were to make a hole in their clothing without using the present invention they would run the risk of having the fabric tear after a small stress or unravel over time. After repeated washes, an unreinforced hole may become a much larger hole than originally desired. The present invention could also be used on any material such as a curtain, a bedspread, carpeting, luggage, or a pocketbook to decorate and personalize it.

The style of patch for material in common use today is typically made of one piece of material and is designed to cover a hole in another piece of material or is designed to be applied on top of the piece of material as a decoration without allowing a person to make a hole in their clothing. Thus, a need exists to allow a user to easily create a reinforced hole in an article of clothing or piece of material. The hole created by the present invention is decorative and durable, i.e., it is able to withstand washing and stress created by a wearer.

BRIEF SUMMARY OF THE INVENTION

The present invention is directed to providing a decorative patch that allows a person to make a hole in an article of clothing or a piece of material without having the piece of material unravel. Another object is to provide a construction that is durable and able to withstand repeated laundering and a wearer's activity. A further object is to provide a construction and a process for applying the construction to a piece of material that is easily used by the person who wishes to decorate their clothing, thereby allowing them maximum expression for their creative instincts.

The decorative patch includes two pieces of material, having corresponding interior apertures of a predetermined shape, that are placed on top of each other so that their interior apertures register with one another. The two pieces of material are joined together around the periphery of their interior apertures. The patch is secured in an aperture in a piece of material to be decorated. The invention also includes a process for creating and reinforcing a hole in a piece of material to be decorated, whereby the patch is placed in the hole such that the first layer of the patch is on the outside and the second layer is on the inside of the piece of material to be decorated, and the patch is then secured onto the piece of material to be decorated.

BRIEF DESCRIPTION OF THE DRAWINGS

The invention is further elaborated in the accompanying drawings in which.

DETAILED DESCRIPTION

Figure 1:
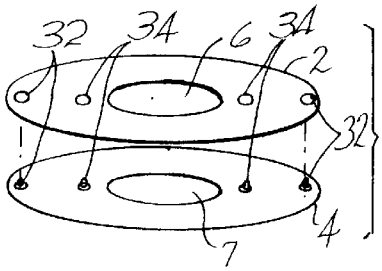
FIG. 1 is an exploded side view of the present invention showing the first and second layer of material being placed on top of each other so that their interior apertures register with one another.
Figure 6:
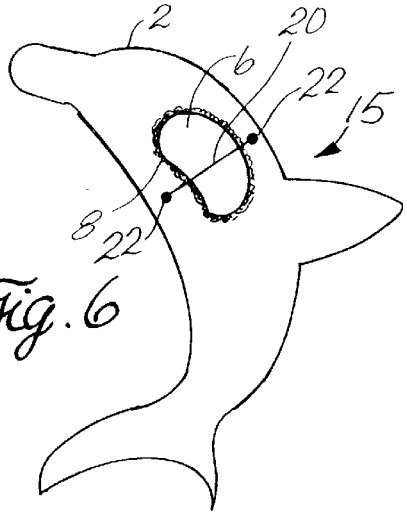
FIG. 6 is the top view of a patch according to the present invention having a peripheral shape of an animal.

The features of the present invention that allow a user to easily create a hole in a piece of material that is durable and decorative are illustrated in the following discussion of the figures and embodiments:

FIG. 1 demonstrates how a first layer of material 2, containing an interior aperture 6, and a second layer of material 4, containing an interior aperture 7, which is a mirror image of the interior aperture 6 (the necessity of the second layer of material's interior aperture being a mirror image is best understood when the shape of the patch and the aperture are nonsymmetrical such as in FIG. 6), are placed on top of each other so that their interior apertures register with one another. In other words, their interior apertures are lined up so that the aperture 6 in the first layer of material 2 neatly overlaps and mates with the aperture 7 in the second piece of material 4. Although layers, 2, 4, of material are shown to be the same size and shape this does not necessarily have to be the case as long as the interior apertures of each of the pieces of material are approximately the same size and shape.

Figure 2:
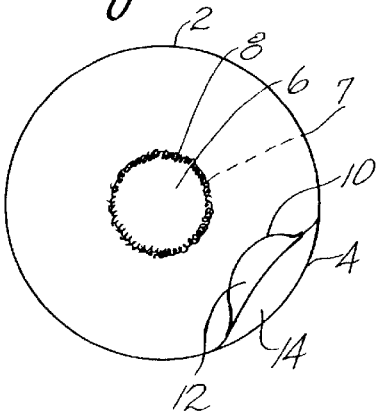
FIG. 2 is a top view of the patch according to the invention showing one section of the first layer of material peeled away and interior apertures secured together.

FIG. 2 shows the assembled patch according to the invention. The first layer 2 and second layer 4 of material are joined together around the periphery 8 of their interior apertures 6 and 7, respectively. A portion 10 of the first layer of material 2 has been peeled away to show the second layer of material 4. The facing side of the first layer 12 and the facing side of the second layer 14 can be seen in the peeled away section. Although the first layer 2 and second layer 4 of material are shown as having a peripheral shape that is the same, this does not necessarily have to be the case.

Figure 3:
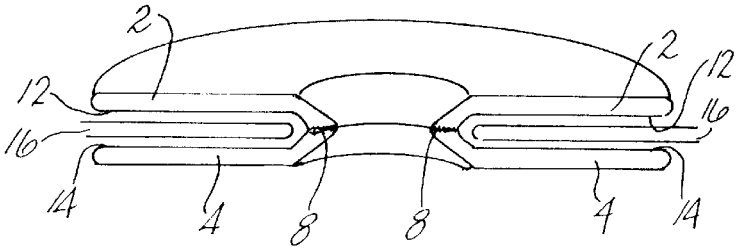
FIG. 3 is an expanded cut-away side view of the present invention showing the patch placed in an interior aperture of a piece of material to be decorated.

FIG. 3 shows a cross-section of the patch according to the present invention placed in an aperture of a piece of material 16 to be decorated. A first layer 2 of material is located on the exterior side of and a second layer 4 of material is located on the interior side of the piece of material 16 to be decorated. The interior side of the first layer of material 12 and the interior side of the second layer of material 14 face each other and also face the piece of material 16, on opposite sides thereof to be decorated. The first layer 2 of material and the second layer 4 of material are joined together around the periphery 8 of their interior apertures.

In one embodiment, the interior side of each layer has an adhesive coated thereon. In manufacture, paper with a release coating overlap the adhesive. Upon installation, the paper is removed and the patch is pressed against the material to be decorated and adhesively secured thereto.

Figure 4:
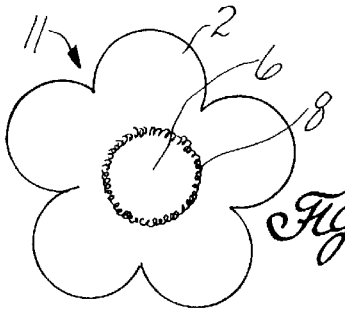
FIG. 4 is the top view of a patch according to the present invention having a peripheral shape of a flower.

FIG. 4 shows a top view of a representative embodiment of the invention in which the peripheral shape of the patch is a flower. The interior aperture 6 is a circle.

Figure 5:
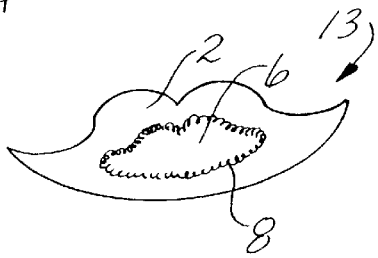
FIG. 5 is the top view of a patch according to the present invention having a peripheral shape of human lips.

FIG. 5 shows a top view of another representative embodiment of the invention in which the peripheral shape of the patch is that of human lips 13. The interior aperture 6 is in the shape of a human mouth.

FIG. 6 shows a top view of another representative embodiment of the invention in which the peripheral shape of the patch is an animal, in this case, a dolphin 15. The interior aperture 6 is in the shape of an elongated irregular oval.

Figure 7:
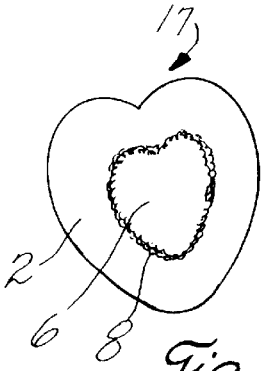
FIG. 7 is the top view of a patch according to the present invention having a peripheral shape of a heart.

FIG. 7 shows a top view of another embodiment of the invention in which the peripheral shape of the patch is a heart 17. The interior aperture 6 is also in the shape of a heart.

In a preferred embodiment the first piece 2 of material is joined to the second piece 4 of material around the periphery 8 of their interior apertures 6 by stitching or embroidery-type stitching. The two pieces of material can also be joined together by heat-sealing, adhesive, heat-activated adhesive, flanged studs that snap into a receiving portion, or crimping. In a further preferred embodiment the facing sides of the first layer 12 and the second layer 14 of material are coated with adhesive or heat-activated adhesive in order to attach the patch in an aperture of a piece of material to be decorated 16. The patch can also be attached to a piece of material to be decorated 16 using crimps, snaps or flanged studs that snap into a receiving portion, buttons, or sewing. One form of mechanical attachment, namely snaps 32, 34 are shown in FIG. 1.

A process for creating a hole in a piece of material to be decorated is also contemplated comprising creating a hole in a piece of material to be decorated, placing the patch in the hole in the piece of material such that the first layer of the material is placed on the outside of the piece of material to be decorated and the second layer of material is placed on the inside of the piece of material to be decorated as in FIG. 3. Both layers of the patch are secured to the piece of material to be decorated. In a preferred embodiment the patch is secured to the piece of material by activating a heat-activated adhesive on the facing sides of the first and second layers of the patch by ironing. In a further preferred embodiment the hole that is created in the piece of material to be decorated is the same shape and slightly larger than the interior aperture of the patch.

As can be seen from the preferred embodiments, the patch is versatile and easy to use. A user can cut a hole anywhere desired or use an existing hole of the appropriate size in a garment and, by placing the patch in the hole and securing it to the material surrounding the hole, reinforce the hole created. The edges of the hole are covered by the two layers of material of the patch thus preventing raveling or tearing of the material to be decorated.

In certain embodiments, for example, the dolphin patch shown in FIG. 6, the hole in the material to be decorated is elongated, the patch is larger and the aperture 6 is elongated and extends longitudinally for a substantial portion of the length of the patch. In such instances, a reinforcing strap or string 20 is laid across aperture 6 and secured on opposite sides at attachments 22 to stabilize and reinforce the patch and prevent it from losing its shape.

While the preferred embodiments of the invention have been shown and described, it will be apparent to those skilled in this art that various modifications may be made in these embodiments without departing from the spirit of the present invention. For that reason, the scope of the invention is set forth in the following claims:

I claim:

1. A decorative patch comprising:

a first layer of material having an interior aperture of a predetermined shape, a second layer of material having an interior aperture of a predetermined shape, wherein the two layers are overlaid such that their shaped apertures register with each other, at least one securing element joining the two layers together around the periphery of their shaped apertures, and at least one securing element capable of attaching the respective layers of the patch in an aperture on opposite sides of a piece of material.

2. The decorative patch of claim 1 wherein the first and second layers of material have a predetermined outer peripheral shape.

3. The decorative patch of claim 2 wherein elements for joining the first and second layers of material around the periphery of their interior shaped apertures are sewing, heat-sealing, flanged studs that snap into a receiving portion, or crimping.

4. The decorative patch of claim 2 wherein an element for attaching the patch in an aperture in a piece of material is heat-activated adhesive applied to the facing sides of the first and second layers of material of the patch.

5. The decorative patch of claim 2 wherein an element for attaching the patch in an aperture in a piece of material is adhesive applied to the facing sides of the first and second layers of material of the patch.

6. The decorative patch of claim 2 wherein elements for attaching the patch in an aperture in a piece of material are crimps.

7. The decorative patch of claim 2 wherein elements for attaching the patch in an aperture in a piece of material are snaps or flanged studs that snap into a receiving portion.

8. The decorative patch of claim 2 wherein elements for attaching the patch in an aperture in a piece of material are buttons.

9. The decorative patch of claim 2 wherein elements for attaching the patch in an aperture in a piece of material are sewn sections.

10. The decorative patch of claim 2 wherein the outer peripheral shape of the first and second layers of material is a flower.

11. The decorative patch of claim 2 wherein the outer peripheral shape of first and second layers of material is that of human lips.

12. The decorative patch of claim 2 wherein the outer peripheral shape of the first and second layers of material is an animal.

13. The decorative patch of claim 2 wherein the outer peripheral shape and the shape of the interior aperture of the first and second layers of material are a heart.

14. The decorative patch of claim 2 wherein the peripheral shape of the first and second layers of material is a geometric figure.

15. The decorative patch of claim 14 wherein the peripheral shape of the first and second layers of material is a circle.

16. The decorative patch of claim 14 wherein the peripheral shape of the first and second layers of material is a square.

17. The decorative patch of claim 1 wherein the material of the patch is cloth, synthetic fabric, velvet, silk, cotton, leather, flannel, plastic, taffeta, polyester, vinyl, rayon, or Dacron.

18. A process for creating and reinforcing a hole in a piece of material comprising the steps of:

(a) creating a hole in the piece of material to be decorated, (b) placing a decorative patch in the hole in the piece of material such that a first layer of material having an interior aperture is placed on the outside of the piece of material to be decorated and a second layer of material having an interior aperture is placed on the inside of the piece of material to be decorated, and (c) securing both layers of patch material to each other around the periphery of these interior apertures and to the piece of material to be decorated.

19. A decorative patch comprising:

a first layer of material having an interior aperture of a predetermined shape, a second layer of material having an interior aperture that is a mirror image of the first layer, wherein the two layers are overlaid such that their shaped apertures register with each other, at least one securing element joining the two layers together around the periphery of their shaped apertures, and at least one securing element for attaching the patch in an aperture in a piece of material;

wherein the first and second layer of material are attached in an aperture in a piece of material to be decorated and said first and second layers respectively overlay opposite sides of the piece of material to be decorated.

20. The decorative patch of claim 19 wherein the aperture in the piece of material is elongated, the aperture in the patch is similarly elongated and a reinforcing element is secured across both apertures.

21. A process for creating and reinforcing a hole in a piece of material comprising the steps of:

(a) creating an aperture in the piece of material to be decorated, (b) securing a decorative patch comprising two layers of patch material each having a centrally located aperture to each other around the periphery of their apertures, c) placing the decorative patch in the aperture in the piece of material such that a first layer of patch material is placed on the outside of the piece of material to be decorated and a second layer of patch material is placed on the inside of the piece of material to be decorated, and (d) securing the layers of patch material to the piece of material to be decorated.

* * * * *